US006739583B2

(12) United States Patent
Ryon

(10) Patent No.: US 6,739,583 B2
(45) Date of Patent: May 25, 2004

(54) METAL FENCE RAIL

(76) Inventor: David Allen Ryon, 1409 E. Seattle, Broken Arrow, OK (US) 74012

( * ) Notice: Subject to any disclaimer, the term of this patent is extended or adjusted under 35 U.S.C. 154(b) by 0 days.

(21) Appl. No.: 10/264,631

(22) Filed: Oct. 5, 2002

(65) Prior Publication Data

US 2003/0127639 A1 Jul. 10, 2003

Related U.S. Application Data

(60) Provisional application No. 60/327,245, filed on Oct. 5, 2001.

(51) Int. Cl.[7] ..... E04H 17/14

(52) U.S. Cl. ..... 256/65.02; 256/65.11

(58) Field of Search ..... 256/19, 59, 65.01, 256/65.02, 65.03, 65.04, 65.11

(56) References Cited

U.S. PATENT DOCUMENTS

| | | | |
|---|---|---|---|
| 2,563,529 | A | 8/1951 | Hawkins |
| 2,563,530 | A | 8/1951 | Hawkins |
| 2,590,929 | A | 4/1952 | Bush |
| 2,944,797 | A | 7/1960 | Magness |
| 3,955,799 | A | 5/1976 | Lauzier |
| 3,973,756 | A | 8/1976 | Lauzier |
| 4,723,760 | A | 2/1988 | O'Sullivan |
| 4,982,933 | A | 1/1991 | Schultz |
| 5,056,283 | A | 10/1991 | Sapinski |
| 5,581,868 | A | 12/1996 | Bisch |
| 5,882,001 | A | 3/1999 | Reinbold |
| 5,967,498 | A | 10/1999 | Junell |
| 6,017,019 | A | 1/2000 | Erwin |
| 6,254,064 | B1 | 7/2001 | Gibbs |
| 6,260,828 | B1 | 7/2001 | English |

*Primary Examiner*—John R. Cottingham
(74) *Attorney, Agent, or Firm*—Capehart Law Firm; Brent A. Capehart

(57) ABSTRACT

A picket fence panel comprising at least two post members aligned substantially vertical and spaced apart is disclosed. A plurality of pickets are aligned substantially vertical to the post members. Each of the pickets have an upper end, a lower end, an upper bore located proximate to the upper end and a lower bore located proximate to the lower end. An upper c-shaped rail and a lower c-shaped rail is also provided. Each rail is aligned and mounted between the post members and has a plurality of paired openings to accept the plurality of pickets. A corresponding plurality of aperture openings are located along each of the upper and lower c-shaped rail. Each aperture has at least two flaps hingedly deposed thereon. First and second rod members extend substantially over the length of the upper and lower c-shaped rail and engage the plurality of pickets and the aperture openings.

1 Claim, 3 Drawing Sheets

METAL FENCE RAIL

REFERENCE TO PENDING APPLICATIONS

This application is based upon U.S. Provisional Patent Application No. 60/327,245 filed on Oct. 5, 2001.

REFERENCE TO MICROFICHE APPENDIX

This application is not referenced in any microfiche appendix.

FIELD OF THE INVENTION

The present invention is generally relates to fence construction and more specifically toward an improved picket fence panel.

BACKGROUND OF THE INVENTION

Picket fence designs are in the prior art including those utilizing hollow or tubular members. These members are secured according to a complicated apparatus utilizing moving parts or in unsatisfactory manner. These prior art fences are difficult and costly to manufacture. Thus there is a need for a picket fence that addresses the concerns above the prior art picket fences.

Below is a listing of the previous cited art references for this application:

| U.S. Pat. No. | Inventor(s) | Title |
|---|---|---|
| 2,563,529 | Hawkins | Metal Balustrade |
| 2,563,530 | Hawkins | Balustrade |
| 2,590,929 | Bush | Railing |
| 2,944,797 | Magness | Balustrade |
| 3,955,799 | Lauzier | Protective Railing Device |
| 3,973,756 | Lauzier | Railing and Method of Assembly |
| 4,723,760 | O'Sullivan | Picket Fence Assembly |
| 4,982,933 | Schultz | Fence Connector Clip and Assembly |
| 5,056,283 | Sapinski | Adjustable Stair Rail |
| 5,581,868 | Bisch | Method and Apparatus for Constructing a Metal Picket Fence |
| 5,882,001 | Reinbold | Modular Fence Structure |
| 5,967,498 | Junell | Modular Fiberglass Railing System |
| 6,017,019 | Erwin | Modular Composite Railing |
| 6,254,064 | Gibbs | Ornamental Ring for Fence |
| 6,260,828 | English | Prefabricated Interlocking Fence Post |

BRIEF SUMMARY OF THE INVENTION

The present invention satisfies the needs discussed above. The present invention is generally directed toward fence construction, more specifically toward a picket fence panel that is simple and easy to manufacture and assemble.

In one aspect, the present invention provides for a picket fence panel comprising at least two post members aligned substantially vertical and spaced apart. A plurality of pickets are aligned substantially vertical to the post members. Each of the pickets have an upper end, a lower end, an upper bore located proximate to the upper end and a lower bore located proximate to the lower end. An upper c-shaped rail and a lower c-shaped rail is also provided. Each rail is aligned and mounted between the post members and has a plurality of paired openings to accept the plurality of pickets. A corresponding plurality of aperture openings are located along each of the upper and lower c-shaped rail. Each aperture has at least two flaps hingedly deposed thereon. First and second rod members extend substantially over the length of the upper and lower c-shaped rail and engage the plurality of pickets and the aperture openings.

Further objects features advantages of the present invention will be apparent to those skilled in the art upon reference to the accompanying drawings and upon reading of the following description of the preferred embodiments.

DETAILED DESCRIPTION OF THE PREFERRED EMBODIMENTS

Figure 1:
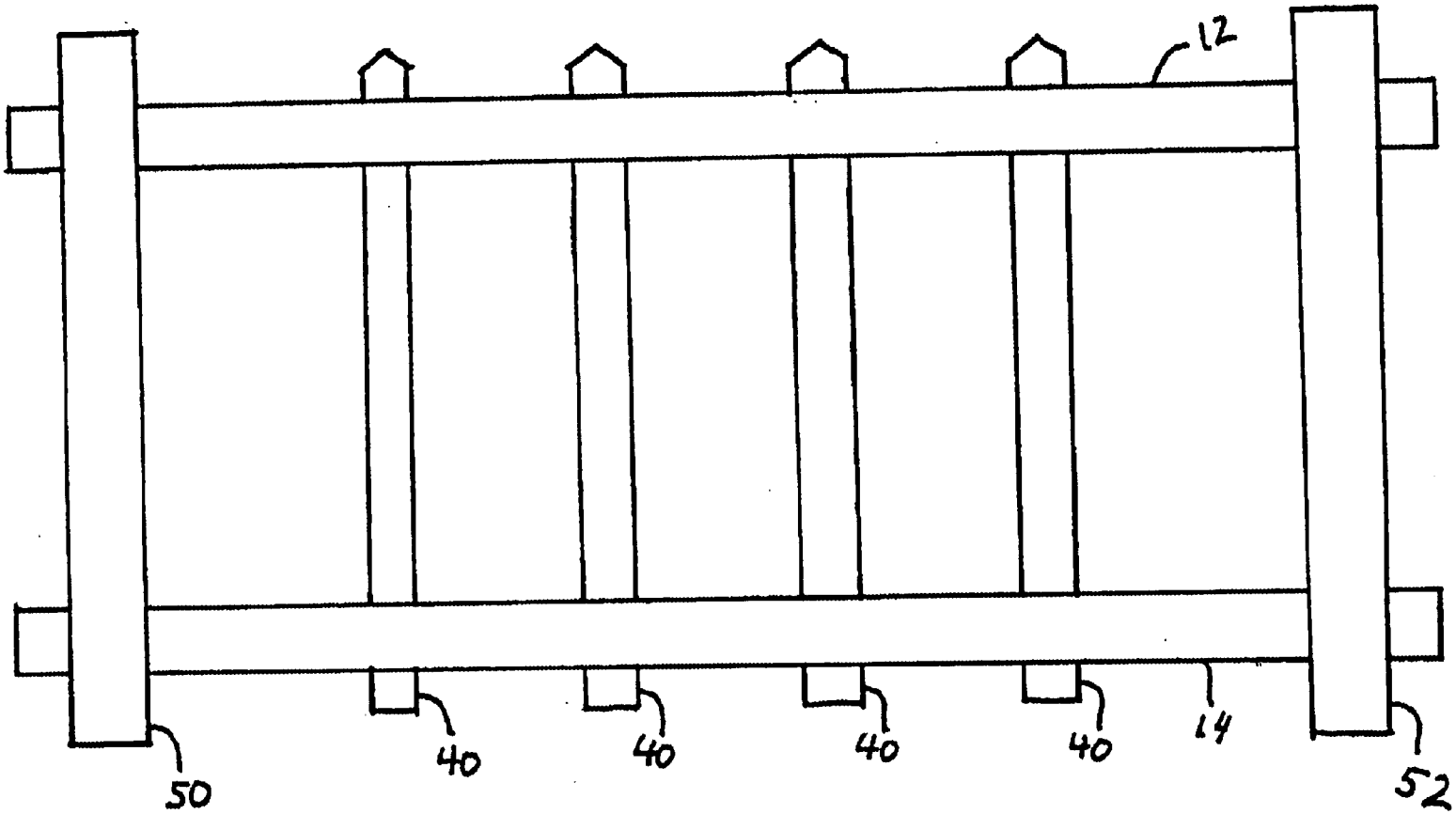
FIG. 1 provides for a prospective view of an embodiment of a picket fence panel as provided by the present invention.
Figure 2:
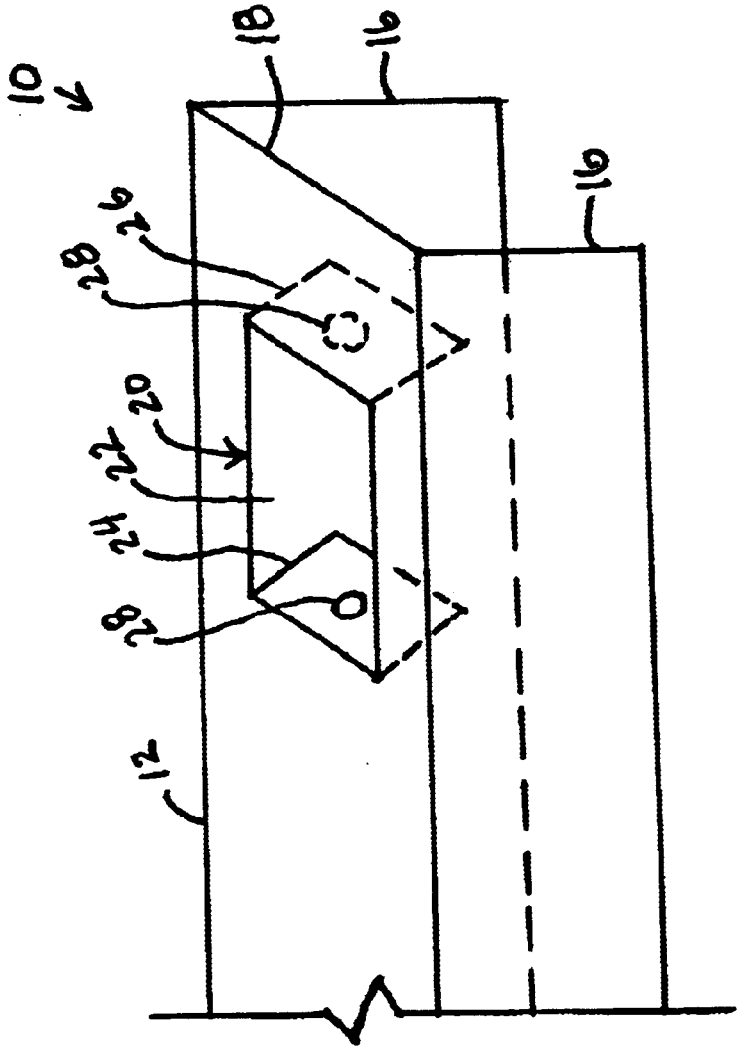
FIG. 2 provides for a prospective view of an embodiment of a rail as provided by the present invention.
Figure 3:
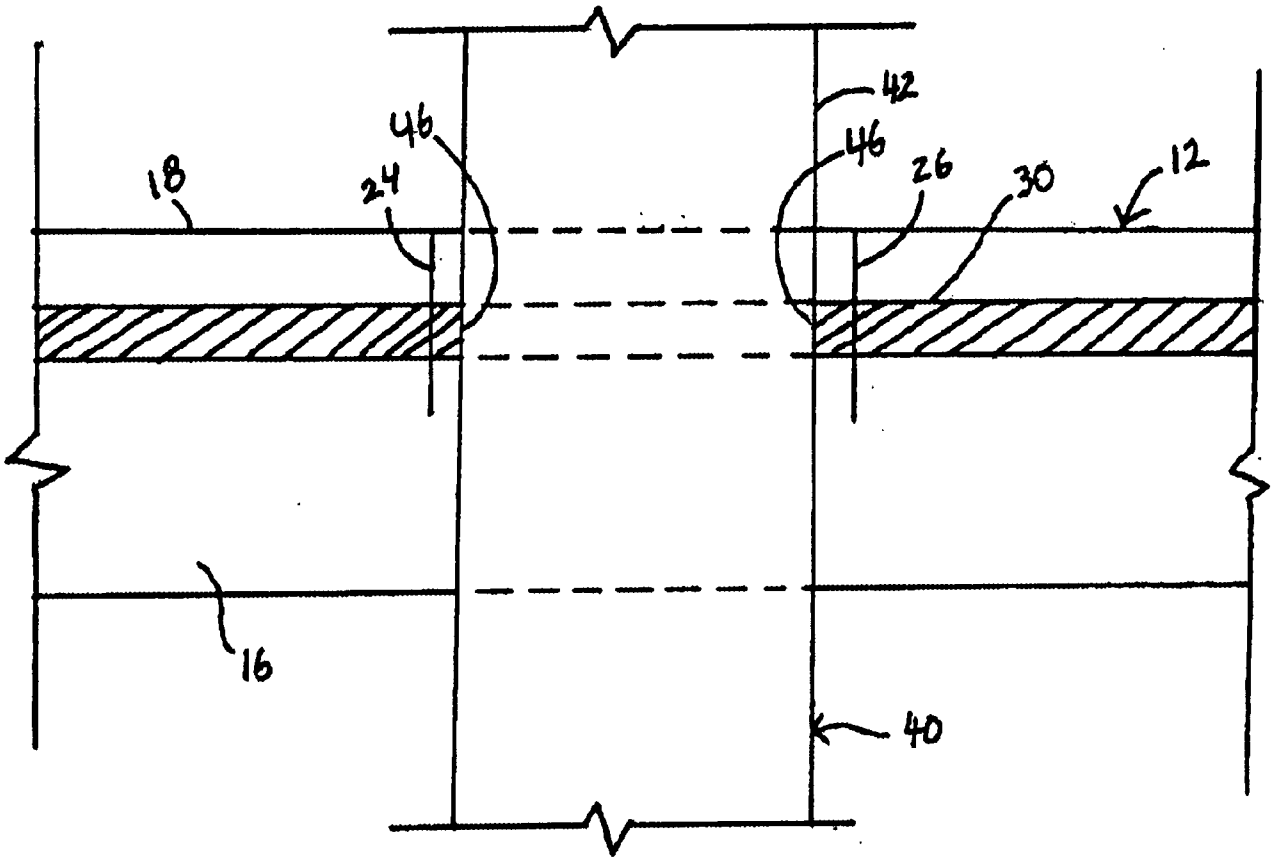
FIG. 3 provides for a cut-away side view of an embodiment of the present invention.

For explaining the present invention in detail it is to be understood that the invention is not limited in its application to the details of the construction and arrangement of the parts illustrated in the accompanying drawings. The invention is capable of other embodiments and of being practiced or carried out in a variety of ways. It is to be understood that the phraseology and terminology employed herein are for the purpose of description and not of limitation.

As depicted in the Figures, a first embodiment 10 of the present invention comprises at least two post members 50 and 52 aligned substantially vertical and spaced apart. A plurality of pickets 40 are aligned substantially vertical to the post members 50 and 52. Each of pickets 40 has an upper end 42, a lower end 44, an upper bore 46 located proximate to the upper end 42 and a lower bore 48 located proximate to lower end 44. An upper c-shaped rail 12 and a lower c-shaped rail 14 is also provided. Each rail has a side 16 and a top 18 along with a plurality of paired openings 20. Each opening has an aperture 22 having at least two flaps 24 and 26 hingedly disposed therewith. Each flap has an opening 28 therein. A rod member 30 extends substantially over the length of each upper rail and lower rail and engages the plurality of pickets and flaps.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. A picket fence panel comprising:

a first post member aligned substantially vertical;

a second post member aligned substantially vertical and spaced apart from said first post member;

a plurality of pickets, each of said plurality of pickets having an upper end, a lower end, and a body; and at least two c-shaped rails, each of said at least two c-shaped rails having two side sections and a top section therebetween positioned to approximately form a "C" cross-section, each of said at least two c-shaped rails being aligned substantially horizontal and mounted between said first post member and said second post member, each of said at least two c-shaped rails having a plurality of openings, each of said plurality of openings accepting one of said plurality of pickets at least two rod members, wherein said at least two rod members equals the number of said at least two c-shaped rails; and at least two flags extending away from each of said openings located on each of said at least two c-shaped rails, each of said flags having an opening therein, wherein each of said plurality of pickets has at least two bores located therethrough and wherein each of said openings aligning with each of said bores located on each of said pickets, said openings and said bores receiving one of said at least two rods.

* * * * *